US006816693B2

(12) United States Patent
Baker et al.

(10) Patent No.: US 6,816,693 B2
(45) Date of Patent: Nov. 9, 2004

(54) APPARATUS AND METHOD FOR REMOVING CARRIER LIQUID FROM A PHOTORECEPTOR SURFACE OR FROM A TONED IMAGE ON A PHOTORECEPTOR

(75) Inventors: James A. Baker, Hudson, WI (US); Gay L. Herman, Cottage Grove, MN (US); Charles W. Simpson, Lakeland, MN (US)

(73) Assignee: Samsung Electronics Co. Ltd., Suwon (KR)

( * ) Notice: Subject to any disclaimer, the term of this patent is extended or adjusted under 35 U.S.C. 154(b) by 77 days.

(21) Appl. No.: 10/402,473

(22) Filed: Mar. 28, 2003

(65) Prior Publication Data

US 2004/0052549 A1 Mar. 18, 2004

(30) Foreign Application Priority Data

Sep. 13, 2002 (KR) ..... 02-55636

(51) Int. Cl.[7] ..... G03G 15/10; G03G 21/00

(52) U.S. Cl. ..... 399/249; 399/343; 399/348

(58) Field of Search ..... 15/256.51, 256.52; 399/237, 249, 250, 251, 343, 348, 352

(56) References Cited

U.S. PATENT DOCUMENTS 5,420,675 A 5/1995 Thompson et al.
5,552,869 A * 9/1996 Schilli et al. ..... 399/249
5,736,286 A 4/1998 Kaneko et al. ..... 430/97
5,978,631 A 11/1999 Lee ..... 399/251
6,047,151 A 4/2000 Carvalho et al. ..... 399/250
6,101,356 A 8/2000 Kim et al. ..... 399/250
6,205,312 B1 3/2001 Kim ..... 399/249
6,493,531 B2 12/2002 Choi ..... 399/251

* cited by examiner

*Primary Examiner*—Hoang Ngo
(74) *Attorney, Agent, or Firm*—Mark A. Litman & Assoc. P.A.

(57) ABSTRACT

A liquid electrophotographic imaging apparatus contains at least one drying sheet for removing excess carrier liquid in a liquid toner toned latent image on a photoconductor surface. The drying sheet comprises a flexible substrate having a first surface and second surface; at least one oleophilic carrier liquid absorptive layer on the first surface of the flexible substrate; and the first surface of the flexible substrate facing said photoconductor surface, latent image or liquid toned latent image. The apparatus may perform a process of providing a toned image on the photoconductor with a liquid toner; contacting an absorbent drying sheet from the supply container to the toned image on the photoconductor or to the photoconductor itself after the image is transferred away; absorbing liquid carrier with the drying sheet, the drying sheet then becoming a used drying sheet; determining whether the used drying sheet is suitable for reuse as an absorbent drying sheet; and placing the used drying sheet in a container.

26 Claims, 6 Drawing Sheets

APPARATUS AND METHOD FOR REMOVING CARRIER LIQUID FROM A PHOTORECEPTOR SURFACE OR FROM A TONED IMAGE ON A PHOTORECEPTOR

BACKGROUND OF THE INVENTION

1. Field of the Invention

This invention relates to electrophotography, especially a drying method, drying materials and apparatus for use with liquid toners.

2. Background of the Art

Electrophotography forms the technical basis for various well known imaging processes, including photocopying and some forms of laser printing. The basic electrophotographic process involves placing a uniform electrostatic charge on a photoconductor element, imagewise exposing the photoconductor element to activating electromagnetic radiation (also referred to herein as "light") and thereby dissipating the charge in the exposed areas to form an electrostatic latent image, developing the resulting electrostatic latent image with a toner, and transferring the toner image from the photoconductor element to a final substrate, such as paper, either by direct transfer or via an intermediate transfer material. The direct or intermediate transfer typically occurs by one of two methods: electrostatic assist (electrostatic transfer) or elastomeric assist (adhesive transfer). The effectiveness of adhesive transfer is controlled by several variables including surface energy, temperature, and pressure. Electrostatic transfer is also affected by surface energy, temperature, and pressure, but the primary driving force causing the toner image to be transferred to the final substrate is via electrostatic forces.

The structure of a photoconductor element generally may be a continuous belt, which is supported and circulated by rollers, or a rotatable drum. All photoconductor elements have a photoconductive layer which transports charge (either by an electron transfer of charge transfer mechanism) when the photoconductive layer is exposed to activating electromagnetic radiation or light. The photoconductive layer is generally affixed to an electroconductive support. The surface of the photoconductor is either negatively or positively charged such that when activating electromagnetic radiation strikes a region of the photoconductive layer, charge is conducted through the photoconductor in that region to neutralize or reduce the surface potential in the illuminated region. An optional barrier layer may be used over the photoconductive layer to protect the photoconductive layer and extend the service life of the photoconductive layer. Other layers, such as adhesive layers or priming layers or charge injection blocking layers are also used in some photoconductor elements. A release layer may be used to facilitate transfer of the image from the photoconductor element (also referred to herein as the photoreceptor) to either the final substrate, such as paper, or to an intermediate transfer element.

Typically, a positively charged toner is attracted to those areas of the photoconductor element which retain a negative charge after the imagewise exposure, thereby forming a toner image which corresponds to the electrostatic latent image. The toner need not be positively charged, although that charge form or a neutral charge is preferable. Some toners (irrespective of their charge) may be attracted to the areas of the photoconductor element where the charge has been dissipated. The toner may be either a powdered material comprising a blend or association of polymer and colored particulates, typically carbon, or a liquid material of finely divided solids dispersed in an insulating liquid frequently referred to as a carrier liquid.

Generally, the carrier liquid is a hydrocarbon that has a low dielectric constant (e.g., less than 3) and a vapor pressure sufficiently high to ensure rapid evaporation of solvent following deposition of the toner onto a photoreceptor, transfer belt, and/or receptor sheet. Rapid evaporation is particularly important for cases in which multiple colors are sequentially deposited and/or transferred to form a single image. Examples of such carrier liquids include NORPAR™ and ISOPAR™ solvents from Exxon Chemical Company.

Liquid toners are often preferable because they are capable of giving higher resolution images and require lower energy for image fixing than do dry toners. However, excess carrier liquid which is transferred to the photoconductor element can create a variety of problems. When either the elastomeric or adhesive transfer mechanism is being used, removal of excess carrier liquid is especially important. The excess carrier liquid can blot or stain the image or can cause smudging or streaking of the images. In addition, if excess carrier liquid is not removed, additional energy will be required at the image fixing step to volatilize the excess carrier liquid. Also, removal of the excess carrier liquid generally leads to improved image clarity and image density.

A variety of methods have been employed to remove excess carrier liquid from a developed toner image. These methods include squeegee rolls, air knives, corona discharge, vacuum removal, and absorption.

U.S. Pat. No. 5,420,675 to Thompson et al. discloses the use of a film forming roll which has a thin, outer layer which is compatible (referred to as 'philic') with the carrier liquid and an inner layer which is carrier liquid-phobic and compressible. The film forming roll of that patent is maintained in contact with a single heating roll. The carrier liquid entrained in the film forming roll is removed by heating the liquid to a temperature greater than or equal to the flashpoint of the liquid.

U.S. Pat. No. 5,552,869 to Schilli et al. discloses a drying method and apparatus for electrophotography using liquid inks. The drying apparatus removes excess carrier liquid from an image produced by liquid electrophotography on a moving organophotoreceptor. The system includes a drying roll that contacts the organophotoreceptor, with an outer layer that absorbs and desorbs the carrier liquid and an inner layer having a Shore A hardness of 10 to 60 which is carrier liquid-phobic, and a heating means to increase the temperature of the drying roll to no more than 5° C. below the flash point of the carrier liquid. In one embodiment, the heating means includes two hot rolls and the system further includes a cooling means that cool the drying roll.

U.S. Pat. No. 5,736,286 to Kaneko et al. discloses the employment of a drying belt to remove carrier fluids in liquid inks.

SUMMARY OF THE INVENTION

This invention addresses problems associated with using a single absorbent roll, absorbent sheet or absorbent belt to absorb excess carrier and a heating roll to remove the absorbed carrier so that the absorbent roll, absorbent sheet or absorbent belt may be reused.

DETAILED DESCRIPTION OF THE INVENTION

Figure 1:
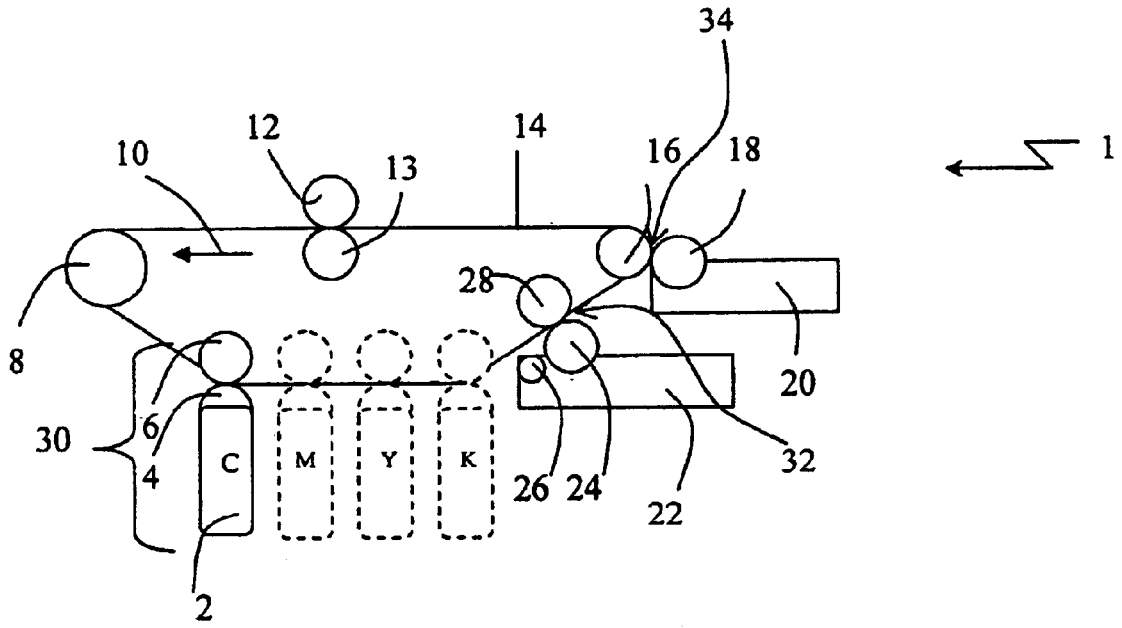
FIG. 1 shows one embodiment of an electrophotographic apparatus using drying sheets with supply and discard cartridges to dry an image on a photoconductor.

A method and materials are used in an apparatus to reduce the presence of excess carrier liquid and excess liquid toner after application of a liquid toner to a latent image on an electrophotographic sheet, belt or roll. A drying member according to the invention is strategically contacted with the latent image at one or more positions along the imaging path. The substrate of the drying member may be opaque or substantially transparent and may comprise one or more layers of appropriately selected materials. The substrate may be constructed of or comprise any suitable components giving the desired properties as described herein. Non-limiting examples of suitable materials for the substrate are polyester such as polyethylene terephthalate and polyethylene naphthalate, polyimide, polysulfone, cellulose triacetate, polyamide, polyolefins, polycarbonate, vinyl resins such as polyvinyl chloride, polyvinylbutyral and polystyrene, and the like. Specific examples of supporting substrates included polyethersulfone (Stabar® S-100 polymer, commercially available from ICI), polyvinyl fluoride (Tedlar® polymer, commercially available from E. I. DuPont de Nemours & Company), polybisphenol-A polycarbonate (Makrofol® film, commercially available from Mobay Chemical Company) and amorphous polyethylene terephthalate (Melinar®, commercially available from ICI Americas, Inc. and Dupont A and Dupont 442, commercially available from E. I. DuPont de Nemours & Company).

The desired thickness of the substrate of the absorbing member depends on a number of factors, including economic considerations. The substrate typically is between 10 microns and 1000 microns thick, preferably between 25 microns and 250 microns. When the drying member is used in a liquid electrophotographic imaging member, the thickness of the substrate should be selected to avoid any adverse affects on the final device and process. The substrate should not be so thin that it splits, crinkles and/or exhibits poor durability characteristics. The substrate likewise should not be so thick that it may give rise to early failure during cycling, a lower flexibility, and a higher cost for unnecessary material.

The absorbent material in the absorbent layer of the at least two layer or the at least one layer absorbing member should be mechanically durable and have a high affinity to the carrier fluids, e.g. hydrocarbons, in the liquid inks. Non-limiting examples of suitable absorbent material are silicone polymer or polysiloxane, fluorosilicone polymer, polyethylene, polypropylene, or a combination thereof. Preferably, the absorbing material is selected from the group consisting of cross-linked silicone polymers and fluorosilicone polymers. The layer is preferably porous at the surface to enable some absorption or flow of liquid into the surface as opposed to only surface adhesion or adsoption.

The absorbent layer should not be too thin that it has a limiting absorption capacity that would be insufficient to enable absorption of liquid carrier at levels anticipated in the use of the system and process. The absorbent layer likewise should not be so thick that it may give rise to cracking, delamination from the seamless belt substrate or roller, and higher cost for unnecessary material. In general, the thickness of the absorbent layer is greater than or equal to about 25 microns, preferably in the range of about 25 to about 1000 microns, more preferably in the range of 25 to 250 microns.

Optional conventional additives, such as, for example, adhesion promoters, surfactants, fillers, expandable particles, coupling agents, silanes, photoinitiators, fibers, lubricants, wetting agents, pigments, dyes, plasticizers, release agents, suspending agents, cross-linking agents, catalysts, and curing agents, may be included in the absorbent layer either for manufacturing requirements of the layer or performance property controls in the layer during use in the practice of the present invention.

The preferred absorbent materials are cross-linked silicone polymers and cross-linked fluorosilicone polymers. The cross-linking of the silicone polymers and fluorosilicone polymers can be undertaken by any of a variety of methods including free radical reactions, condensation reactions, hydrosilylation addition reactions, hydrosilane/silanol reactions, and thermally initiated or photoinitiated reactions relying on the activation of an intermediate to induce subsequent cross-linking.

Preferably, the cross-linking agent is present in an amount of greater than about 0 to about 20, such as 0.1 to 20 parts by weight of the preferably about 5 to about 15, and more preferably about 8 to about 12, parts by weight.

Commercially available examples of a cross-linking agent include those commercially available under the trade designations SYL-OFF® 7048 and 7678 (from Dow Corning, Midland, Mich.), SYLGARD 186 (from Dow Corning, Midland, Mich.), NM203, PS 122.5 and PS 123 (from Huls America Inc.), DC7048 (Dow Corning Corp.), F-9W-9 (Shin Etsu Chemical Co. Ltd.) and VXL (O Si Specialties).

The above components for the absorbent material are preferably reacted in the presence of a catalyst capable of catalyzing addition cross-linking of the above components to form an adsorbent release coating composition. Suitable catalysts include the transition metal catalysts described for hydrosilylation in *The Chemistry of Organic Silicone Compounds*, Ojima, (S. Patai, J. Rappaport eds., John Wiley and Sons, New York 1989). Such catalysts may be either heat or radiation activated. Examples include, but are not limited to, alkene complexes of Pt(II), phosphine complexes of Pt(I) and Pt(O), and organic complexes of Rh(I). Choroplatinic acid based catalysts are the preferred catalysts. Inhibitors may be added as necessary or desired in order to extend the pot life and control the reaction rate. Commercially available hydrosilation and hydrosilylation catalysts based on chloroplatinic acid include those available under the trade designations: PC 075, PC 085 (Huls America Inc.), Syl-Off 7127, Syl-Off 7057, Syl-Off 4000 (all from Dow Corning Corp.), SL 6010-D1 (General Electric), VCAT-RT, VCAT-ET (O Si Specialties), and PL-4 and PL-8 (Shin Etsu Chemical Co. Ltd.).

Other cross-linking reactions may also be used to form the cross-linked silicone polymer with a bimodal distribution of chain lengths between cross-links. Cross-linking reactions that have been used include free radical reactions, condensation reactions, hydrosilylation addition reactions, and hydrosilane/silanol reactions. Cross-linking may also result from photoinitiated reactions relying on the activation of an intermediate to induce subsequent cross-linking.

Peroxide induced free radical reactions that rely on the availability of C—H bonds present in the methyl side groups provide a non-specific cross-link structure that would not result in the desired network structure. However, the use of siloxanes containing vinyl groups with vinyl specific peroxides could provide the desired structure given the appropriate choice of starting materials. Free radical reactions can also be activated by UV light or other sources of high energy radiation, e.g., electron beams.

The condensation reaction can occur between complementary groups attached to the siloxane backbone. Isocyanate, epoxy, or carboxylic acids condensing with amine or hydroxy functionalities have been used to cross-link siloxanes. More commonly, the condensation reaction relies on the ability of some organic groups attached to silicon to react with water, thus providing silanol groups which further react with either the starting material or other silanol group to produce a cross-link. It is known that many groups attached to silicon are readily hydrolyzable to produce silanol groups. In particular, alkoxy, acyloxy, and oxime groups are known to undergo this reaction. In the absence of moisture, these groups do not react, and therefore, provide a sufficient working life relative to unprotected silanol groups. On exposure to moisture, these groups spontaneously hydrolyze and condense. These systems may be catalyzed as necessary. A subset of these systems includes tri- or tetra-functional silanes containing three or four hydrolyzable groups.

Hydrosilane groups can react in a similar manner as described for the condensation reaction. They can react directly with SiOH groups or may first be converted to an OH group by reaction with water before condensing with a second SiOH moiety. The reaction may be catalyzed by either condensation or hydrosilylation catalysts.

The hydrosilylation addition reaction relies on the ability of the hydrosilane bond to add across a carbon-carbon double bond in the presence of a noble metal catalyst. Such reactions are widely used in the synthesis of organofunctional siloxanes and to prepare release liners for pressure sensitive adhesives.

Well known photoinitiated reactions can be adapted to cross-link siloxanes. Organofunctional groups such as cinnamates, acrylates, epoxies, etc., can be attached to the siloxane backbone. Additionally, the photoinitiators may be grafted onto the siloxane backbone for improved solubility. Other examples of this chemistry include addition of a thiol across a carbon-carbon double bond (typically, an aromatic ketone initiator is required), hydrosilane/ene addition (the free radical equivalent of the hydrosilylation reaction), acrylate polymerization (can also be electron beam activated), and radiation induced cationic polymerization of epoxides, vinyl ethers, and other functionalities.

Other useful additives for the absorbent layer are expandable particles, both blowable and non-blowable. Non-limiting examples of expandable particles are Expancel™ microspheres (commercially obtained from Expancel, Inc., Duluth, Ga.), Expandable Polystyrene Bead (commercially obtained from StyroChem International, Fort Worth, Tex.), Matsumoto Microsphere F series (commercially obtained from Matsumoto Yushi-Seiyaku Co., Ltd., Osaka, Japan), Dualite™ M6050AE (commercially available from Sovereign Specialty Chemicals, Akron, Ohio). The preferred expandable particles are Expancel™ microspheres and Matsumoto Microsphere F series. Particulate materials allow for some natural porosity in the layer, in addition to surface tension adsorption on the material itself.

Expancel™ microspheres are small spherical plastic particles. The microspheres consist of a polymer shell encapsulating a gas. When the gas inside the shell is heated, it increases its pressure and the thermoplastic shell softens, resulting in a dramatic increase in the volume of the microspheres. When fully expanded, the volume of the microspheres may increases up to more than 40 times. The product range includes both unexpanded and expanded microspheres. Unexpanded microspheres are used as blowing agents in many areas such as printing inks, paper, textiles, polyurethanes, PVC-plastics and more. The expanded microspheres are used as lightweight fillers in various applications.

Matsumoto Microsphere F series are thermo-expandable micro spheres having 10 to 30 microns diameter produced by encapsulating low-boiling-point hydrocarbons with a wall of copolymers of vinylidene chloride, acrylonitrile and the like through in-situ polymerization. They are mixed with various resins and formed into a layer containing separate pores at low temperature for a short time through the steps of coating, impregnating or kneading.

The expandable particles can be mixed with absorbent materials by a variety of conventional mixing techniques including hand stirring, propeller mixing, Cowles or high shear mixing, roller mixing, homogenization, and microfluidization. The weight ratio of expandable particles to absorbing materials ranges from 0.5 to 25%. Preferably, the weight ratio is between 4 and 10%.

The existing absorbing or "drying" process consists of absorbing the excess carrier fluid from the image face, after the image is plated onto the photoreceptor and before the image is transferred to the receiving medium, by means of an absorptive polymer layer coated onto a roll, belt, disk, or sheet. Other methods of carrier fluid removal include: drying the image from the backside of the image using vacuum assistance through a semi-permeable membrane; thermally drying the receiving medium after the image has been transferred, absorbing by the drying member, of excess carrier fluid from a non-absorptive intermediate transfer belt after the image has been transferred to the receiving medium; and thermally evaporating the excess carrier fluid from an absorptive transfer belt and/or the image into the surrounding environment.

Regeneration or "renewing" the drying member is desirable because absorption of carrier fluid by the drying member may be repeated after the carrier has been absorbed and the imaging cycle completed. Regeneration is usually facilitated by heat, pressure, or vacuum or a combination thereof. After regeneration is completed, the drying member is capable of absorbing more carrier fluid because the drying member remains unsaturated with the carrier fluid. The existing process consists of thermal regeneration and may be used as such in this invention. In this system, regeneration may occur after a number of cycles or when a particular concentration of carrier solvent in the member is attained. Regeneration may alternatively occur when an entire discard cartridge is full of saturated sheets.

The invention describes a liquid electrophotographic imaging apparatus containing at least one drying element (e.g., a sheet, stack of sheets, or serrated sheet for removing excess carrier liquid. The excess carrier liquid is present from the deposited or plated toner. The excess liquid carrier is present in a liquid toner toned latent image on a photoconductor surface or remains on the photoconductor surface after the toned but not fused or permanently adhered liquid toner image is transferred to an intermediate surface or to the final image receiving surface. At least one drying sheet (in its varied forms) may be present as a flexible substrate having a first surface and second surface and at least one oleophilic carrier liquid absorptive layer on the first surface of the flexible substrate. The first surface of the flexible substrate faces the photoconductor surface, latent image or liquid toned latent image when it is placed in position to absorb liquid carrier. The absorbent sheet may be provided from a carrier tray (e.g., stacked within the tray and individually positioned to absorb the liquid carrier from the photoconductor surface), from a roll of sheets (which may be separate sheets that overlap to retain sheets in place underneath them), or a serrated roll of sheets where modest force will remove a sheet from the roll. The first surface and said second surface both may have an oleophilic absorptive layer affixed to each of the first surface and the second surface. The absorbent sheet may have a compliant inner layer is affixed between the flexible substrate and the at least one oleophilic carrier liquid absorptive layer. The inner layer may be oleophobic to carrier liquid and may be at least less oleophilic then the absorbent layer. The inner layer comprises a polymer selected from nitrile elastomers, fluorosilicone polymers, fluorocarbon polymers, and polyurethane polymers. Some desirable materials for the at least one absorbent layer comprises a polymer selected from the group consisting of silicone polymers, ethylene/propylene copolymers, polybutadienes, and polyisoprenes. The apparatus may provide sheet handling systems that move the drying sheet form a storage or supply area to position the drying sheet into contact with a surface of a photoreceptor where the sheet will be able to contact carrier liquid. This is done during the electrophographic imaging process for the purpose of drying liquid carrier. This drying sheet can assist in more rapidly and controllably changing the toner image to the desired liquid carrier content and properties. The absorbent layer of the sheet may have a surface energy that is at least 1 dyne/cm less than the surface energy of the surface it is positioned to contact and to dry. The imaging apparatus of this invention should provide a drying sheet is capable of absorbing 2%–70% of its own weight in carrier liquid (e.g., 2–70% liquid carrier/98%–30% absorbent sheet), with sufficient retention properties that the absorbent layer is a non-leaching absorbent This means that the absorbent layer retains the carrier liquid with sufficient strength that ambient moisture and water in landfills will not remove solvent in an amount that would be prohibited by regulatory provisions. An example of a standard for absorption is where a non-leaching absorbent with 20% by weight carrier liquid (liquid/absorbent) buried in black dirt with 10% by weight water content, would lose 2% or less of the solvent (that is 0.4% of the weight of solvent plus absorbent) in a six-month period at 20° C. and 40% relative humidity. The absorbent layer should be capable of absorbing carrier liquid from a freshly deposited liquid toner image and subsequently desorbing the carrier liquid upon application of heat or pressure. If the applied liquid toner has a solids content of between 20–25% by weight, the absorbent sheet should be able to convert the solid content to at least 40% with three seconds contact and 50 g/cm$^2$ pressure on the sheet.

As noted earlier, the imaging apparatus may provide the absorbent sheet (which is capable of absorbing carrier liquid from an image and subsequently desorbing the carrier liquid). The sheets may be treated to desorb the absorbed liquid carrier either singly or in a cartridge upon application of heat or pressure.

The electrophotographic imaging apparatus of the invention may be alternatively described as having the ability to remove excess liquid carrier from a photoconductor surface. The electrophotgraphic imaging apparatus might then comprise electrophotographic imaging system capable of providing an electrophotographic image on a photoreceptor; an absorbent (liquid carrier absorbent) image drying sheet which contacts the photoreceptor, the image drying sheet having at least an outer layer which absorbs carrier liquid, the surface of the drying sheet in contact with the photoreceptor having a Shore A hardness of 10 to 60. The drying sheet, after contacting the photoreceptor surface from which the toned image has been transferred, absorbs carrier liquid from a surface of the photoreceptor and the drying sheet then becomes a used drying sheet. The apparatus preferably has a disbursing cartridge for supplying non-saturated drying sheets for use and a receiving cartridge for receiving used drying sheets. The supply cartridge and the disbursing cartridge are within a single housing. There may be a heating element in the apparatus for evaporating carrier liquid from used drying sheets or a pressurizing zone for pressing liquid carrier from the absorbent sheet.

A method of drying or reducing the liquid carrier content of a liquid toner image or a photoconductor may comprise steps such as providing at least one absorbent drying sheet;

- providing an electrophotographic apparatus comprising at least
  - a photoconductor
  - at least one supply container and at least one discard container for the at least one absorbent drying sheet;
- providing a toned image on the photoconductor with a liquid toner;
- contacting an absorbent drying sheet from the supply container to the toned image on the photoconductor or to the photoconductor itself after the image is transferred away;
- absorbing liquid carrier with the drying sheet, the drying sheet then becoming a used drying sheet;
- determining whether the used drying sheet is suitable for reuse as an absorbent drying sheet; and
- placing the used drying sheet in a container selected from the group consisting of: supply container, re-supply container, regeneration container, or discard container depending upon the used drying sheet's determination of suitability of use.

The method may use a regeneration container wherein heat is applied to the used drying sheets causing at least a portion of the absorbed carrier to be expelled from the saturated drying sheets thereby converting saturated drying sheets to non-saturated drying sheets. The method may also use a regeneration container wherein pressure is applied to the used drying sheets causing at least a portion of the absorbed carrier to be expelled from the saturated drying sheets thereby converting saturated drying sheets to non-saturated drying sheets. The discard container may be used by recycling the container and/or the sheets after regeneration.

A method of removing carrier liquid a) from a liquid toner image on a photoreceptor or b) from a photoreceptor after transfer of a liquid toner image to a final substrate may be practiced with steps comprising

- providing a plurality of absorbent drying sheets in a cartridge, wherein the sheets are stacked such that there is a top of the stack and a bottom of the stack;
- providing an electrophotographic apparatus comprising at least
  - a photoconductor
  - a cartridge of drying sheets;

providing a toned image on the photoconductor;

contacting an absorbent drying sheet from the cartridge to the toned image on the photoconductor, or to the photoconductor itself after the image is transferred away, the drying sheet on absorbing liquid carrier becoming a used drying sheet;

replacing the used drying sheet at the top of the stack in the absorbent drying sheet cartridge for re-supply or discard. By using non-leachable absorbent layers and non-leachable absorbent sheets, the cartridge may be removed while it is filled with used drying sheets for disposal in a landfill.

A method of practicing the present invention can also include drying carrier liquid from a toner image on a photoconductor or from a photoconductor after transfer to a final substrate comprising the steps of:

providing an electrophotographic apparatus comprising at least a photoconductor a continuous absorbent drying sheet having a beginning and an end, the beginning attached to a take-up roll or spool and the end attached to a disbursement roll or spool, the intermediate portion thereof coiled around the disbursement spool with at least a portion of the sheet contacting the photoreceptor;

providing a toned image on the photoconductor;

contacting the continuous absorbent drying sheet to the toned image on the photoconductor, or to the photoconductor itself after the image is transferred away, creating a used portion of the continuous absorbent drying sheet; and simultaneously disbursing fresh length of the continuous absorbent drying sheet and taking-up the used portion of the continuous drying sheet.

These and other non-limiting aspects of the invention will be seen from the following examples.

EXAMPLES

Comparative Example A

The formulation of Comparative Example A (by weight) consisted of 20.20 parts of SE-33 gum (commercially available from General Electric, Waterford, N.Y.); 0.28 part of VDT 954 silicone additive (commercially available from Gelest, Inc. Tullytown, Pa.); 0.84 part of an inhibitor comprising 70 parts of diethyl fumarate and 30 parts of benzyl alcohol (commercially available from Aldrich, Inc., Milwaukee, Wis.); 5.43 parts of Sylgard™ 186 Crosslinker (commercially available from Dow Corning Silicones, Auburn, Mich.); 0.84 part of Syl-Off® 7678 Crosslinker (commercially available from Dow Corning Silicones, Auburn, Mich.); 0.41 part of Syl-Off® Catalyst DC-4000 (Dow Corning Silicones, Auburn, Mich.); and 70.92 parts of n-heptane (commercially available from Phillips Petroleum, Houston, Tex.).

Heptane was added to a 1-liter glass jar. The jar was then placed underneath an air mixer with a Silverson Lab Emulsion Mixer (commercially available from Silverson Ltd, London, England). The gum was weighed out and added to the jar while mixing at 3200 rpm for 3 hours. Then VDT 954 silicone was added to the jar and the solution was mixed for 15 minutes. The inhibitor was then added and the batch was mixed for another 5 minutes. Sylgard™ 186 and Syl-Off® 7678 Crosslinker were added to the jar. The entire solution was mixed for another 20 minutes before Syl-Off® Catalyst DC-4000 was added. After the addition of the catalyst, the solution was mixed for 15 minutes.

The solution was pumped through a 1.2 microns absolute filter (Part #0430Y012Y, commercially available from Porous Media, St. Paul, Minn.) at a flow rate of 40 ml/min into a clean jar. After filtering, a 1.5 g sample was taken and measured for % of solids by a halogen solids balance (Model #HR-73, commercially available from Mettler Toledo, Columbus, Ohio).

The above solution was coated on a 9 cm×20 cm polyester sheet using a knife coater with a wet thickness of 15 mils. The coating was allowed to flash dry in the atmosphere for 10 minutes before oven curing for 10 minutes at 150° C.

Example 1

The preparation procedure of Example 1 was similar to that for Comparative Example A described above, except that 2.5 g of Expancel™ beads (Grade 053 DU, commercially available from Expancel, Inc., Duluth, Ga.) was added to 250 g of the solution prepared above for Comparative Example A and mixed together for 3 minutes; and that the coating was cured at 165° C.

Example 2

The preparation procedure of Example 2 was similar to that for Example 1, except that the curing temperature was 120° C.

Desorption Test

The desorption test was run on a halogen solids balance (Model #HR-73, commercially available from Mettler Toledo, Columbus, Ohio). The unit was preprogrammed to maintain at 70° C. All samples (in the form of 2.54 cm diameter disk) were soaked in Norpar™ 12 (commercially available from Exxon) for 3 hours prior to running the test. The saturated samples were dried by paper towel and then placed in a halogen solids balance (Model #HR-73, commercially available from Mettler Toledo, Columbus, Ohio) at 70° C. for a period of 3.5 minutes. The weight of each sample was measured every 30 seconds during the 3.5 minute period. Then the weight loss of each sample with time was calculated.

Absorption Test

The objective of this test is to determine the relative carrier fluid absorption efficiency of each example by using Norpar™ 12. A Kruss Model K12/3 tensiometer (commercially available Kruss GmbH, Hamburg, Germany) with its preinstalled software was used for this measurement. A #3140 Pyrex cylinder was filled with Norpar™ 12 to ¾ full. The cylinder was placed into the bowl on the Kruss tensiometer.

Samples in the form of 2.54 cm square were cut from each example mentioned above by a JDC Precision Sample Cutter. The square samples were kept as flat as possible. Each sample was handled and transferred to the tensiometer by a tweezers.

The preinstalled "adsorption test" was selected for this test. The measuring frequency was 20 seconds. The total absorption time was 220 seconds.

DETAILED DESCRIPTION OF THE DRAWINGS

"Adhesive transfer" means that transfer was primarily effected by surface tension phenomena (e.g., including tack) between the receptor surface and the temporary carrier surface or medium for the toner.

"Electrostatic transfer" means that transfer was primarily effected by electrostatic charges or charge differential phenomena between the receptor surface and the temporary carrier surface or medium for the toner.

In electrophotographic printing, the toner image plated to a photoreceptor is initially typically no more than 30%, and often no more than 25%, and most typically about 22% solids (e.g., a preferred range being between about 15–30%, 18–25%, or 19–24% solids). In cases of adhesive transfer, it is necessary to dry the toned image to be approximately 70% solids (e.g., 50–100% solids, or 60–80% solids) so that the ink can form a sticky film, thereby permitting transfer to the final medium. This drying may be achieved by methods that include: squeegee rolls, air knives, corona discharge, vacuum removal, and absorption. Absorption is preferred/used because the other methods may exert too much stress on the toner image and smear it.

The previous art, however, has many associated problems. For example, during continuous printing, the drying roll or belt becomes saturated with carrier, which must be removed. This carrier is typically removed by application of a heated roller that causes the carrier in the drying roll to evaporate. This evaporation step in turn leads to a need for vapor collection in the imaging line (a complex and usually costly system typically comprising at least a fan, collection ducts, and a condenser). The evaporated and condensed carrier is then stored in liquid form in the printer until disposal.

Another problem that occurs in the prior art carrier removal attempts is that the repetitive use of the same belt or roller degrades the absorbent layer of the belt, introducing artifacts/contaminants to the toner image, and generally decreasing the life of the drying roller or belt. The high heat necessary to continually evaporate a non-volatile or high flashpoint solvent from the absorbent layer also has the effect of degrading the surface of the belt or roller. Over time a continuously re-used belt or roller will pick up sufficient contaminants (e.g. paper fibers, dust, toner particles, etc.) to increase the surface energy. If the surface energy of the roll or belt increases, it will begin to adhere to surfaces that have a lower surface energy, like the photoreceptor, the intermediate transfer member, or even the toner. To keep contaminants from altering the surface energy of the roll or belt, a cleaning mechanism is frequently employed in an attempt to maintain integrity.

An irreversible problem associated with the drying rollers and belts of the prior art is when ozone from the corona in an electrophotographic printer oxidizes the surface of the roll or belt. Once ozone damage is done, there is no possibility for renewal.

Finally, the drying rolls of the prior art are expensive to make and difficult to exchange. They frequently have a metal core, adding to the cost of manufacture. Both belts and rollers are also a consumable component of a printer that generally require a visit by a service person for exchange.

FIG. 1 is a side view of one embodiment of a printing apparatus 1 using the claimed articles and one embodiment of the claimed method. The apparatus 1 shown comprises at least one image development station 30 comprised of a toner cartridge 2, a developer roll 4 for electrostatically plating ink solids from liquid carrier to a photoconductor belt 14 or drum (not shown) and a backup roll 6 to create a nip. A monochrome printer may have as few as one development station 30, but a multi-color printer will have a plurality of image development stations (shown in FIG. 1 with dashed lines). A toned image is generated on a photoreceptor 4 (method not described) and, in this embodiment, is transferred to a photoreceptive belt or drum 14 (shown here in this non-limiting figure as a belt). The photoreceptive belt or drum 14 ("photoreceptor") is supported and tensioned by rollers 8, 16. The photoreceptor moves in a direction indicated by arrow 10 through each image development station 30, receiving toned images. The final destination of the composite toned image is shown here between rollers 12, 13 where it is transferred to the final substrate (not shown). The transfer step can be accomplished using adhesive transfer or electrostatic transfer methods, or a combination of both. As can be seen from FIG. 1, nearly all rollers in the electrophotographic printer require a backup roller when contacting a belt because of a need for nip pressure. When, for example, a photoconductive drum is used, the drum itself becomes the back pressure needed to form the nip. The inclusion, therefore, of roller 28 is to form a nip 32 with a drying sheet supply roller 24. Container or cartridge 22 holds a supply of non-saturated absorbent drying sheets (not shown). Once a toner image is transferred to the photoreceptor 14, a non-saturated drying sheet is selected and readied (positioned for feeding into the system) in the cartridge. The optional inclusion of a feeder roller 26 can help. As the toner image nears the nip 32, the non-saturated drying sheet (not shown) is applied to the surface of the image (which faces supply roller 24), passing together with the photoreceptor 14 and the image through the nip 32. The surfaces remain in contact until after passing through nip 34 formed by rollers 16, 18, at which time the drying sheet, which has now been used, is stored for re-use in a recycle storage container (device not shown) or discarded in a discard container or cartridge 18. Contact time and choice of absorbent material will determine final dryness or moisture of the image. If adhesive transfer is used, the image will need to be at least 50% solids by weight. If electrostatic transfer is used, the image will need to be less than 40% solids by weight. If a regeneration means is used for the drying sheets or pads (not shown, but general means for regenerating sheets containing volatile liquids are known in the art), when the original supply cartridge 22 is emptied, the cartridge 18 with the regenerated sheets can be simply exchanged for the original supply cartridge 22 without calling service personnel.

Figure 2:
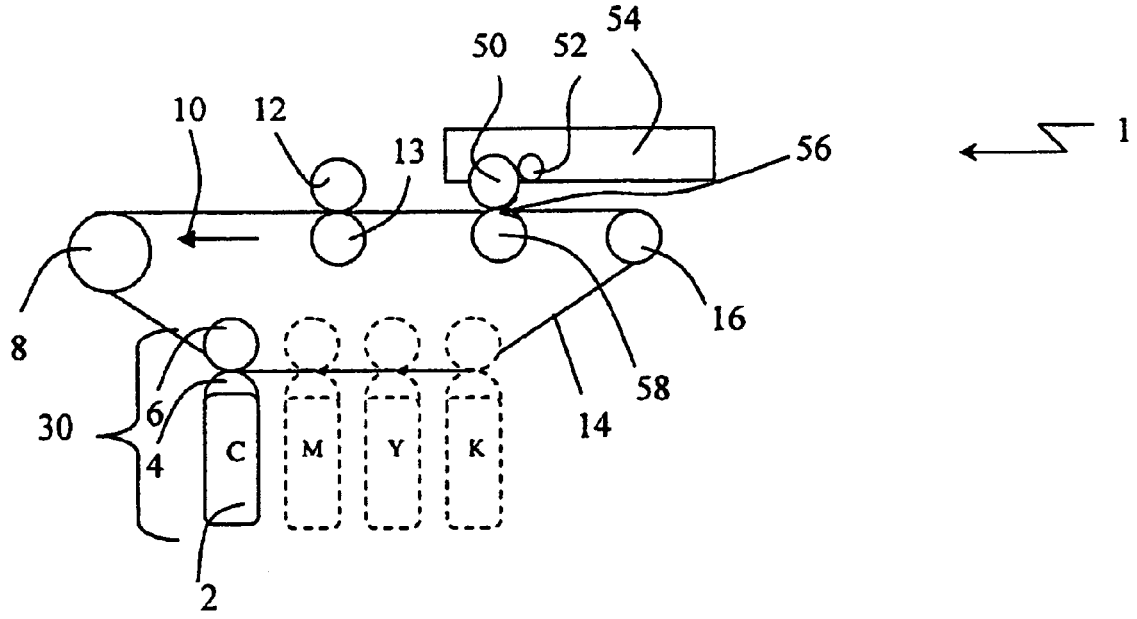
FIG. 2 shows one embodiment of an electrophotographic apparatus using drying sheets to dry an image on a photoconductor with one cartridge for both supply and discard.

FIG. 2 shows the same electrophotographic apparatus 1 as in FIG. 1, with a different drying sheet apparatus. In this embodiment, the cartridge 54 not only stores non-saturated drying sheets, but also stores the saturated sheets as well, using rolls such as 50 and 52 to select a sheet and make contact with the photoconductor 14. A roller 58 can help in creating a nip for pressure if the photoconductor 14 is a belt.

Figure 3:
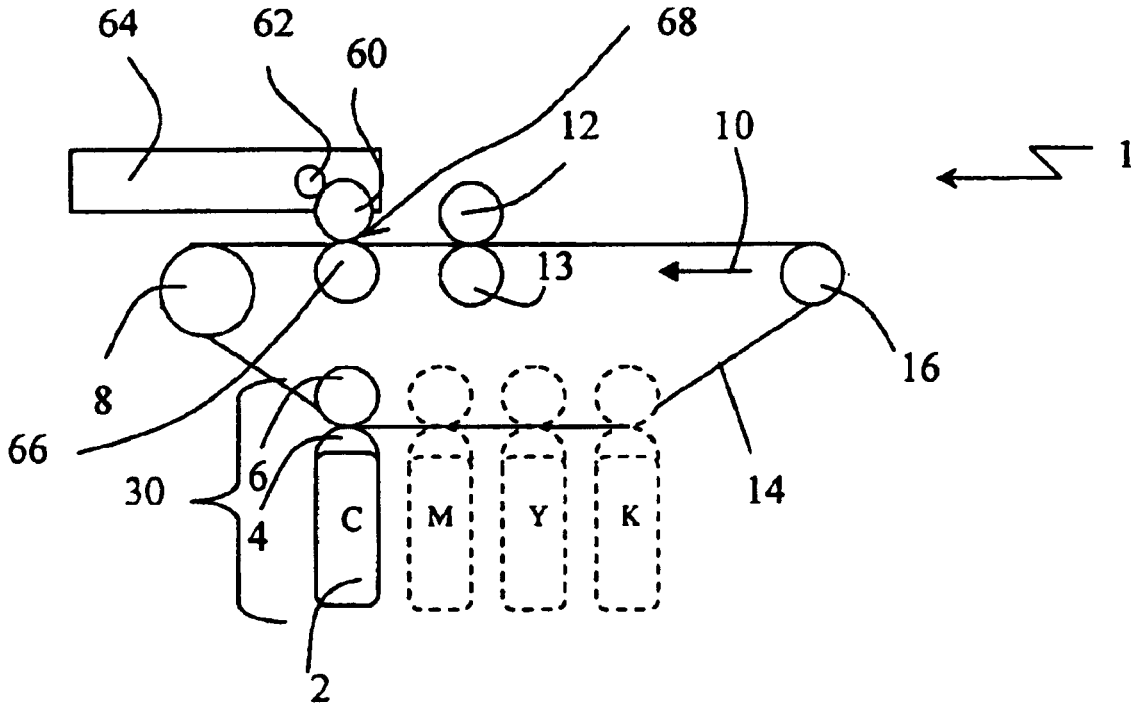
FIG. 3 shows one embodiment of an electrophotographic apparatus using drying sheets to dry a photoreceptor belt with one cartridge for both supply and discard.

FIG. 3 shows an identical electrophotographic apparatus 1 as in FIG. 2, however the location of the drying sheet cartridge is moved. In this embodiment, the drying sheets do not dry the carrier from a toned image, but instead dry excess carrier from a photoreceptor belt 14 after final image transfer.

Figure 4:
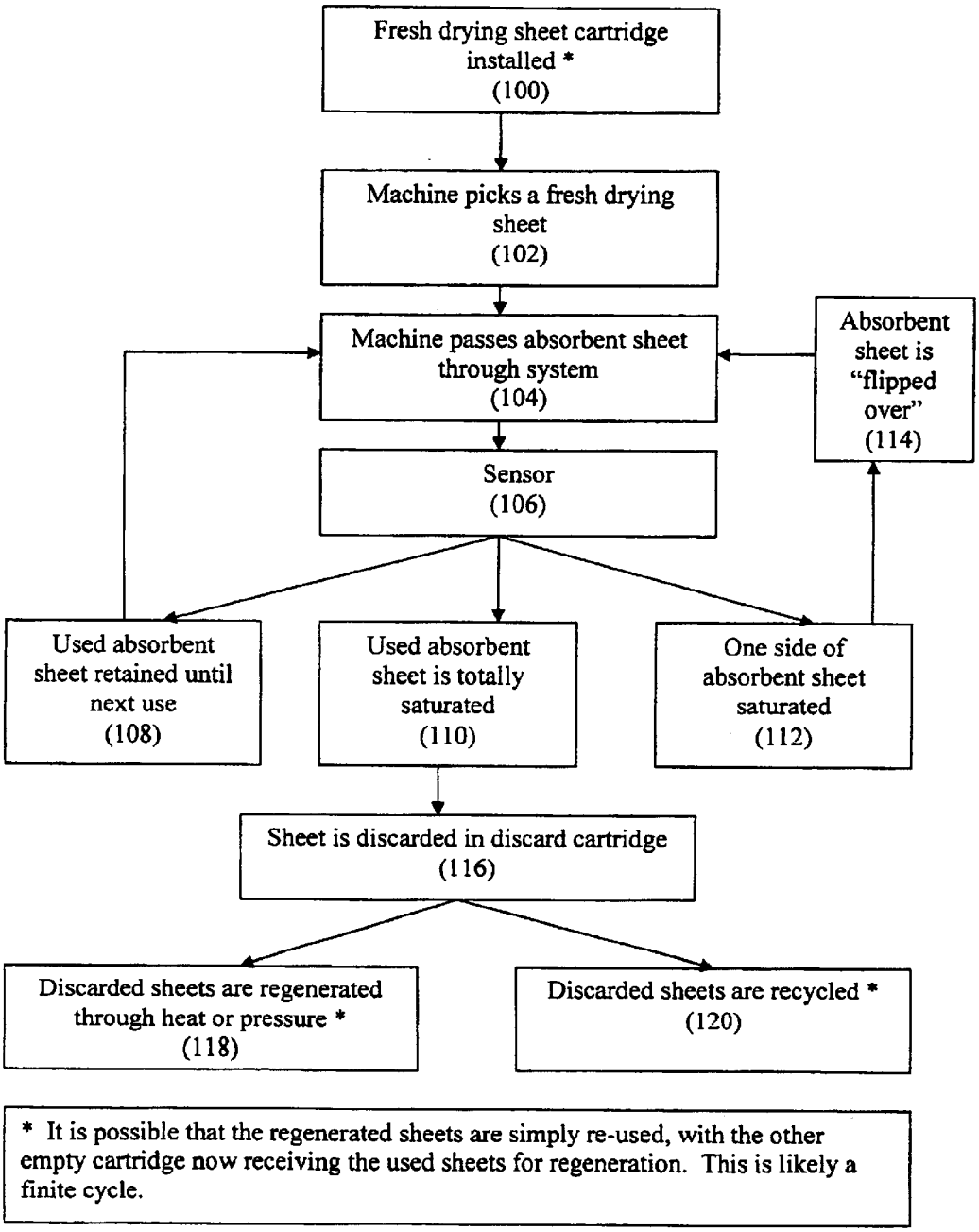
FIG. 4 is a flow chart depicting steps in an embodiment of a method according to the invention.

FIG. 4 is a flow chart, depicting the steps and method of using a drying sheet in an electrophotographic apparatus.

Figure 5:
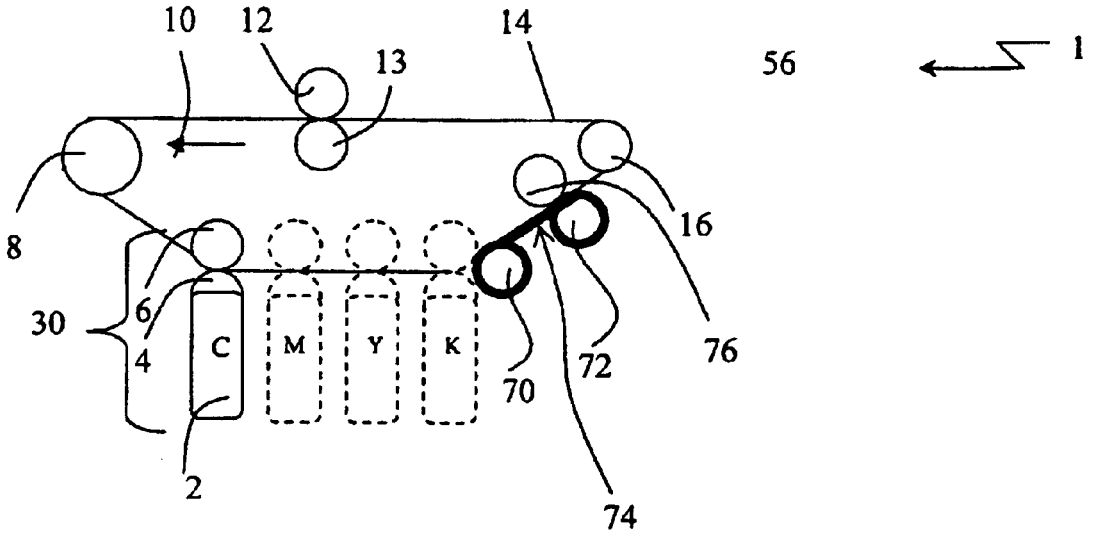
FIG. 5 shows one embodiment of an electrophotographic apparatus using a rolling sheet to dry an image or a photoreceptor belt

FIG. 5 shows the same electrophotographic apparatus as in FIGS. 1–3. In this embodiment, the apparatus for drying the image or the photoconductor after final transfer consists of two rolls 70 and 72. Around a supply roll 70 is wound a length of drying sheet material (substrate coated with absorbent). The end of the drying sheet is attached to a discard roll 72. The discard roll 72 may form a nip with another roll 76 or a photoconductive drum. The length of drying sheet between the supply and discard rolls 70, 72 contacts the image, ITM, or photoreceptor at 74, depending on where the drying rolling sheet is placed in the printing apparatus. The placement of the drying supply and discard rollers in FIG. 5 is for illustrative purposes only and is not meant to limit placement of the drying device.

Figure 6:
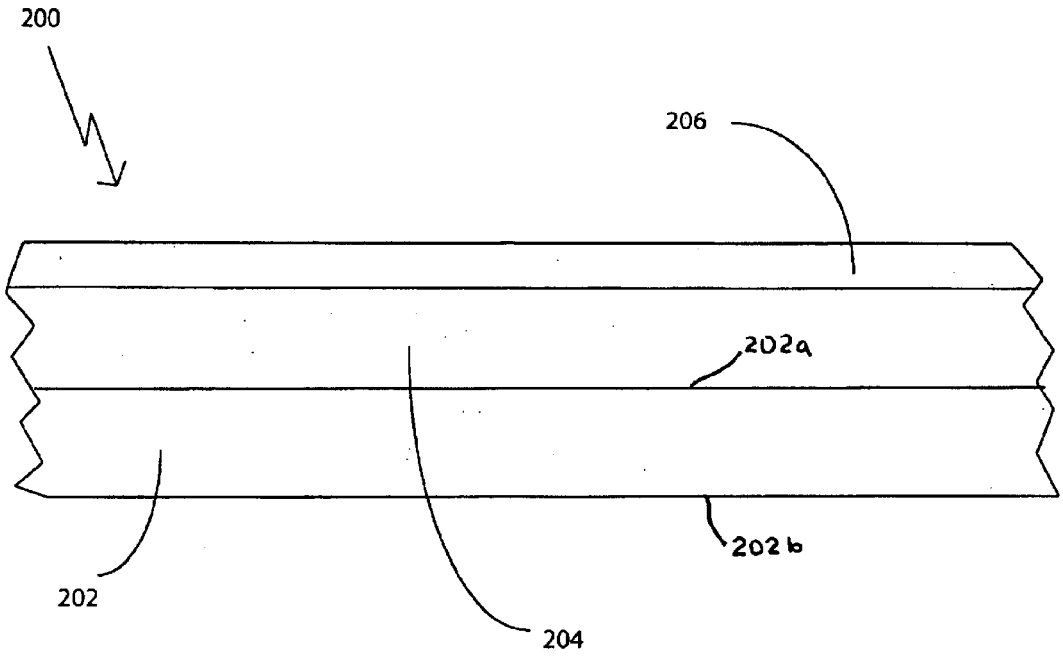
FIG. 6 shows a sheet according to the present invention.

FIG. 6 shows a sheet 200 according to the present invention, the sheet 200 comprising a flexible substrate 202, first surface 202*a*, second surface 202*b*, absorptive layer 206 and compliant inner layer 204.

What is claimed:

1. A liquid electrophotographic imaging apparatus containing a multiplicity of independent drying sheets for removing excess carrier liquid in a liquid toner toned latent image on a photoconductor surface, at least one independent drying sheet comprising, a flexible substrate having a first surface and a second surface;

at least one oleophilic carrier liquid absorptive layer on the first surface of the flexible substrate; and the first surface of the flexible substrate facing said photoreceptor surface, latent image or liquid toned latent image.

2. The imaging apparatus of claim 1 wherein said first surface and said second surface have an oleophilic absorptive layer affixed to each of the first surface and the second surface.

3. The imaging apparatus of claim 1 wherein a compliant inner layer is affixed between the flexible substrate and the at least one oleophilic carrier liquid absorptive layer.

4. The imaging apparatus of claim 3 wherein the inner layer is oleophobic to carrier liquid.

5. The imaging apparatus of claim 3 wherein the inner layer comprises a polymer selected from nitrile elastomers, fluorosilicone polymers, fluorocarbon polymers, and polyurethane polymers.

6. The imaging apparatus of claim 1 wherein the at least one absorbent layer comprises a polymer selected from the group consisting of silicone polymers, ethylene/propylene copolymers, polybutadienes, and polyisoprenes.

7. The imaging apparatus of claim 1 wherein systems moving a single independent drying sheet position the single independent drying sheet into contact with a surface of a photoreceptor to contact carrier liquid during an electrophographic imaging process for the purpose of drying liquid carrier and wherein absorbent layer of the single independent drying sheet has a surface energy that is at least 1 dyne/cm less than the surface energy of the surface it is positioned to contact and to dry.

8. The imaging apparatus of claim 1 wherein the independent drying sheet is capable of absorbing 2%–70% of its own weight in carrier liquid, wherein the absorbent layer is a non-leaching absorbent which retains the carrier liquid with sufficient strength that ambient moisture and water in landfills will not remove solvent in an amount that would be prohibited by regulatory provisions.

9. The imaging apparatus of claim 8 wherein the non-leaching absorbent with 20% by weight carrier liquid (liquid/absorbent) buried in black dirt with 10% by weight water content, would lose 2% or less of the solvent (that is 0.4% of the weight of solvent plus absorbent) in a six-month period at 20° C.

10. The imaging apparatus of claim 1 wherein the absorbent layer is capable of absorbing carrier liquid from an image and subsequently desorbing the carrier liquid either singly or in a cartridge upon application of heat or pressure.

11. The imaging apparatus of claim 3 wherein the at least one absorbent layer comprises a polymer selected from silicones, ethylene/propylene copolymers, polybutadienes, and polyisoprenes.

12. The imaging apparatus of claim 3 wherein systems moving a single independent drying sheet position the single independent drying sheet into contact with a surface of a photoreceptor to contact carrier liquid during an electrophographic imaging process for the purpose of drying liquid carrier and wherein absorbent layer of the sheet has a surface energy that is at least 1 dyne/cm less than the surface energy of the surface it is positioned to contact and to dry.

13. The imaging apparatus of claim 3 wherein the single independent drying sheet is capable of absorbing 2%–70% of its own weight in carrier liquid.

14. The imaging apparatus of claim 11 wherein the absorbent layer is a non-leaching absorbent.

15. The imaging apparatus of claim 11 wherein the absorbent layer is capable of absorbing carrier liquid from an image and subsequently desorbing the carrier liquid either singly or in a cartridge upon application of heat or pressure.

16. An electrophotographic imaging apparatus having the ability to remove excess liquid carrier from a photoreceptor surface, the electrophotgraphic imaging apparatus comprising:

an electrophotographic imaging system capable of providing an electrophotographic image on a photoreceptor;

a source of individual single drying sheets that are absorbent image drying sheets that contact the photoreceptor, each individual image drying sheet having at least an outer layer which absorbs carrier liquid, the surface of the drying sheet in contact with the photoreceptor having a Shore A hardness of 10 to 60;

wherein the individual drying sheet, after contacting the photoreceptor, absorbs carrier liquid from a surface of the photoreceptor and the individual drying sheet then becomes a used drying sheet;

a disbursing cartridge for supplying individual non-saturated drying sheets for use; and a receiving cartridge for receiving used individual drying sheets.

17. The apparatus of claim 16 wherein the supply cartridge and the disbursing cartridge are within a single housing.

18. The apparatus of claim 16 further comprising a heating element for evaporating carrier liquid from used individual drying sheets.

19. The apparatus of claim 16 further comprising a pressure element for squeezing carrier liquid from used individual drying sheets.

20. A method of drying a toner image or a photoreceptor comprising the steps of:

providing at least one individual absorbent drying sheet;

providing an electrophotographic apparatus comprising at least a photoreceptor at least one supply container and at least one discard container for the at least one individual absorbent drying sheet;

providing a toned image on the photoreceptor with a liquid toner;

contacting an individual absorbent drying sheet from the supply container to the toned image on the photoreceptor or to the photoreceptor itself after the image is transferred away;

absorbing liquid carrier with the individual drying sheet, the drying sheet then becoming a used individual drying sheet;

determining whether the used drying sheet is suitable for reuse as an absorbent drying sheet; and placing the used drying sheet in a container selected from the group consisting of: supply container, re-supply container, regeneration container, or discard container depending upon the used drying sheet's determination of suitability of use.

21. The method of claim 20 using a regeneration container wherein heat is applied to the used individual drying sheets causing at least a portion of the absorbed carrier to be expelled from the substantially saturated drying sheets thereby converting substantially saturated individual drying sheets to individual non-saturated drying sheets.

22. The method of claim 20 using a regeneration container wherein pressure is applied to the used individual drying sheets causing at least a portion of the absorbed carrier to be expelled from the substantially saturated individual drying sheets thereby converting substantially saturated drying sheets to non-saturated drying sheets.

23. The method of claim 20 using a discard container wherein the container of used individual drying sheets is recycled.

24. The method of claim 20 using a discard container wherein the container of used individual drying sheets meets regulatory requirements of non-leachability and is disposed of in a landfill.

25. A method of removing carrier liquid a) from a liquid toner image on a photoreceptor or b) from a photoreceptor after transfer of a liquid toner image to a final substrate comprising the steps of:

providing a plurality of individual absorbent drying sheets in a cartridge, wherein the individual absorbent diving sheets are stacked such that there is a top of the stack and a bottom of the stack;

providing an electrophotographic apparatus comprising at least a photoreceptor a cartridge of individual absorbent drying sheets;

providing a toned image on the photoreceptor;

contacting an individual absorbent drying sheet from the cartridge to the toned image on the photoreceptor, or to the photoreceptor itself after the image is transferred away, the individual absorbent drying sheet on absorbing liquid carrier becoming a used individual drying sheet;

replacing the used individual drying sheet at the top of the stack in the absorbent drying sheet cartridge for re-supply or discard.

26. The method of claim 25 wherein the individual absorbent drying sheet is non-leaching with respect to the carrier liquid further comprising the step of removing the cartridge filled with used individual drying sheets for disposal in a landfill.

* * * * *